US012297015B2

(12) United States Patent
Willett et al.

(10) Patent No.: US 12,297,015 B2
(45) Date of Patent: May 13, 2025

(54) FLUID DISPENSING CLOSURE DEVICE FOR A FLUID CONTAINER

(71) Applicant: SMART CAPS GROUP, INC., Calgary (CA)

(72) Inventors: Kristopher Willett, Calgary (CA); Garner Meszaros, Calgary (CA)

(73) Assignee: Smart Caps Group, Inc., Calgary (CA)

( * ) Notice: Subject to any disclaimer, the term of this patent is extended or adjusted under 35 U.S.C. 154(b) by 0 days.

(21) Appl. No.: 17/983,728

(22) Filed: Nov. 9, 2022

(65) Prior Publication Data

US 2023/0150734 A1 May 18, 2023

Related U.S. Application Data

(60) Provisional application No. 63/278,831, filed on Nov. 12, 2021.

(51) Int. Cl.
*B65D 47/24* (2006.01)
*B65D 47/26* (2006.01)

(52) U.S. Cl.
CPC ..... *B65D 47/242* (2013.01); *B65D 47/263* (2013.01)

(58) Field of Classification Search
CPC ..... B65D 47/242; B65D 47/263
See application file for complete search history.

(56) References Cited

U.S. PATENT DOCUMENTS

| | | | | |
|---|---|---|---|---|
| 2,758,759 | A | 8/1956 | Carpenter | |
| 5,897,037 | A | 4/1999 | Mann | |
| 8,231,032 | B2 | 7/2012 | Puma | |
| 9,669,971 | B2 * | 6/2017 | Panec | B65D 47/242 |
| 2003/0183662 | A1 * | 10/2003 | Ingram | B65D 47/263 222/548 |
| 2004/0050884 | A1 * | 3/2004 | Boggs | B65D 47/127 222/549 |
| 2006/0022000 | A1 | 2/2006 | Boggs et al. | |
| 2010/0001018 | A1 | 1/2010 | Puma | |
| 2012/0168441 | A1 * | 7/2012 | Lane | B65D 47/242 220/212 |

(Continued)

FOREIGN PATENT DOCUMENTS

| | | | |
|---|---|---|---|
| BR | 9001589 | * | 5/1991 |
| FR | 2663300 | * | 12/1991 |
| WO | 2015184396 | | 12/2015 |

*Primary Examiner* — Bob Zadeh

(74) *Attorney, Agent, or Firm* — Ryan W. Dupuis; Michael R. Williams; Ade & Company Inc.

(57) ABSTRACT

A fluid dispensing closure device for a bottle has an outer member with a collar portion sized to thread externally onto the neck and an inner sleeve disposed within the collar portion to be received within the opening in the neck of the bottle, and an annular surface extending radially between a top end of the inner sleeve and the collar portion to seal against the top of the neck. A valve member is movably axially relative to a valve seat on the inner sleeve. An actuator member includes an externally accessible external portion rotatable relative to the outer member by an operator and an internal portion connected with the valve member such that rotation of the actuator member drives axial displacement of the valve member between open and closed positions. The device fits within the dimensions of convention bottle caps.

14 Claims, 7 Drawing Sheets

(56) References Cited

U.S. PATENT DOCUMENTS

| | | | | |
|---|---|---|---|---|
| 2015/0274385 | A1* | 10/2015 | Zoppas | B65D 47/248<br>215/329 |
| 2023/0150734 | A1* | 5/2023 | Willett | B65D 47/242<br>222/52 |

* cited by examiner

FLUID DISPENSING CLOSURE DEVICE FOR A FLUID CONTAINER

This application claims the benefit under 35 U.S.C. 119(e) of U.S. provisional application Ser. No. 63/278,831, filed Nov. 12, 2021.

FIELD OF THE INVENTION

The present invention relates to a closure device for capping the opening in the neck of a fluid container, for example a bottle having a neck that is externally threaded, and more particularly the present invention relates to a closure device having a valve member incorporated therein for operation between an open position for dispensing fluid from the fluid container therethrough and a closed position for containing fluid under pressure within the fluid container.

BACKGROUND

Carbonated beverages are commonly sold in bottles that have a neck that is externally threaded to receive a cap that closes the top opening in the neck of a bottle to contain the liquid beverage within the bottle. The liquid beverage is initially packaged within the bottle under considerable gas pressure within the headspace in the bottle as to maintain carbonation of the liquid beverage in the bottle. Larger bottles typically have sufficient volume to contain several serving portions of the carbonated liquid beverage therein; however, upon initially removing the cap to serve the first portion, the gas pressure within the headspace is lost, so that even if the cap is replaced, the liquid beverage tends to quickly lose carbonation during subsequent storage of the remaining serving portions.

U.S. Pat. No. 8,231,032 by Puma discloses various embodiments of a replacement cap for closing the opening at the neck of the bottle which permit the liquid beverage to be dispensed through the cap without fully removing the cap from the bottle. This allows the cap to be opened and closed while the bottle remains in an inverted orientation so that the pressurized headspace can be maintained within the bottle, which in turn assists in maintaining carbonation of any remaining unserved portions of the liquid beverage stored within the bottle. In each instance, the threaded connection of the cap to the bottle must be loosened to open the cap sufficiently to dispense the beverage; however, the pressurized contents of the bottle force some of the liquid beverage into the threaded connection between the cap and the bottle while dispensing. The leftover beverage within the threaded connection after dispensing a serving portion of the liquid beverage can interfere with subsequent ease of opening and closing of the cap such that the cap becomes more difficult to open with each subsequent use.

SUMMARY OF THE INVENTION

According to one aspect of the invention there is provided a fluid dispensing closure device for a fluid container including a neck defining an opening at a top of the neck and external threads on the neck, the device comprising:

an outer member including (i) a collar portion having an inner diameter sized to receive the neck of the fluid container therein and defining internal threads thereon so as to be arranged to be threaded onto the external threads on the neck of the fluid container, (ii) an inner sleeve disposed within the collar portion and having an outer diameter sized to be received within the opening in the neck of the fluid container, the inner sleeve defining a fluid passage through the outer member in an axial direction of the inner sleeve, and (iii) an annular surface extending radially between a top end of the inner sleeve and the collar portion so as to be arranged to form a seal against a top end of the neck of the fluid container about the opening of the fluid container;

a valve member supported on the inner sleeve so as to be movable relative to the inner sleeve in the axial direction of the inner sleeve between a closed position in which a valve body portion of the valve member is seated on a valve seat on the inner sleeve to block fluid flow through the fluid passage of the inner sleeve and an open position in which the valve body portion of the valve member is displaced in the axial direction from the valve seat to allow fluid flow through the fluid passage;

an actuator member rotatably supported on the outer member and including (i) an external portion that is externally accessible on the collar portion of the outer member and (ii) an internal portion in operative connection with the valve member such that rotation of the actuator member drives axial displacement of the valve member between the open position and the closed position thereof.

The operation of the valve member relative to a separate outer member that remains tightly threaded onto the fluid container while operating in either the open or closed positions of the closure device prevents any liquid from entering into the threaded connection to the fluid container. Furthermore, the externally accessible actuator member operatively connected to the valve member allows operation of the internal valve member between open and closed positions in a compact arrangement that fits approximately within the dimensions of convention caps for closing beverage containers.

The valve arrangement can be further applied to a variety of liquid containers including bottles, jugs or other suitable containers for containing liquids to provide optimal control over dispensing of the liquid with minimum spillage.

The actuator member may be restricted from moving in the axial direction as the valve member is displaced between the open position and the closed position.

The inner sleeve of the outer member preferably mates non-rotatably with one of the valve member and the actuator member such that relative movement between the outer member and said one of the valve member and the actuator member is restricted to translating movement in the axial direction. In the illustrated embodiment, the valve member mates non-rotatably with the outer member such that the valve member is restricted to translation movement relative to the outer member between the open and closed positions of the valve member.

The actuator member may be operatively connected to the valve member by a threaded connection.

Preferably the valve seat is an annular surface at a bottom end of the inner sleeve of the outer member and the valve body portion of the valve member spans across the bottom end of the inner sleeve in the closed position. In this instance, a first one of the valve seat and the valve body portion may support an annular flange projecting therefrom in the axial direction while a second one of the valve seat and the valve body portion may have an annular groove formed thereon, in which the annular flange is received within the annular groove in the closed position of the valve member.

The valve member may include a tubular body portion received within the inner sleeve of the outer member, in which the tubular body portion has an outer diameter which is similar to an inner diameter of the inner sleeve. In this instance, the internal portion of the actuator member may comprise a tubular body received within the tubular body portion of the valve member, in which the internal portion of the outer member has an outer diameter which is similar to an inner diameter of the tubular body portion of the valve member.

The device may further include a sealing interface between the actuator member and the outer member which maintains a pressurized seal between the actuator member and the outer member as the valve member is displaced between the open and closed positions.

The internal portion of the actuator member may comprise a tubular body received within the fluid passage of the outer member, while the external portion of the actuator member may comprise an annular flange extending across a top end of the collar portion of the outer member. In this instance, the annular flange may terminate at an outer perimeter edge having an outer diameter which is approximately equal to an outer diameter of the collar portion of the outer member. When the annular flange terminates at an outer perimeter edge, the outer perimeter edge may be knurled.

The collar portion of the outer member may include an annular groove defining a downwardly facing, annular shoulder surface on the collar portion that is perpendicular to the axial direction, while the external portion of the actuator member may include an undercut area locating a catch therein that engages the shoulder surface on the collar portion that prevents the actuator member from being displaced in the axial direction relative to the outer member.

Preferably the outer member, the valve member, and the actuator member each consist of polyethylene terephthalate material. In this manner, the material of the closure device and the material of a typical bottle upon which the closure device is mounted are formed of the same material to simplify the recycling of the bottle and closure device.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
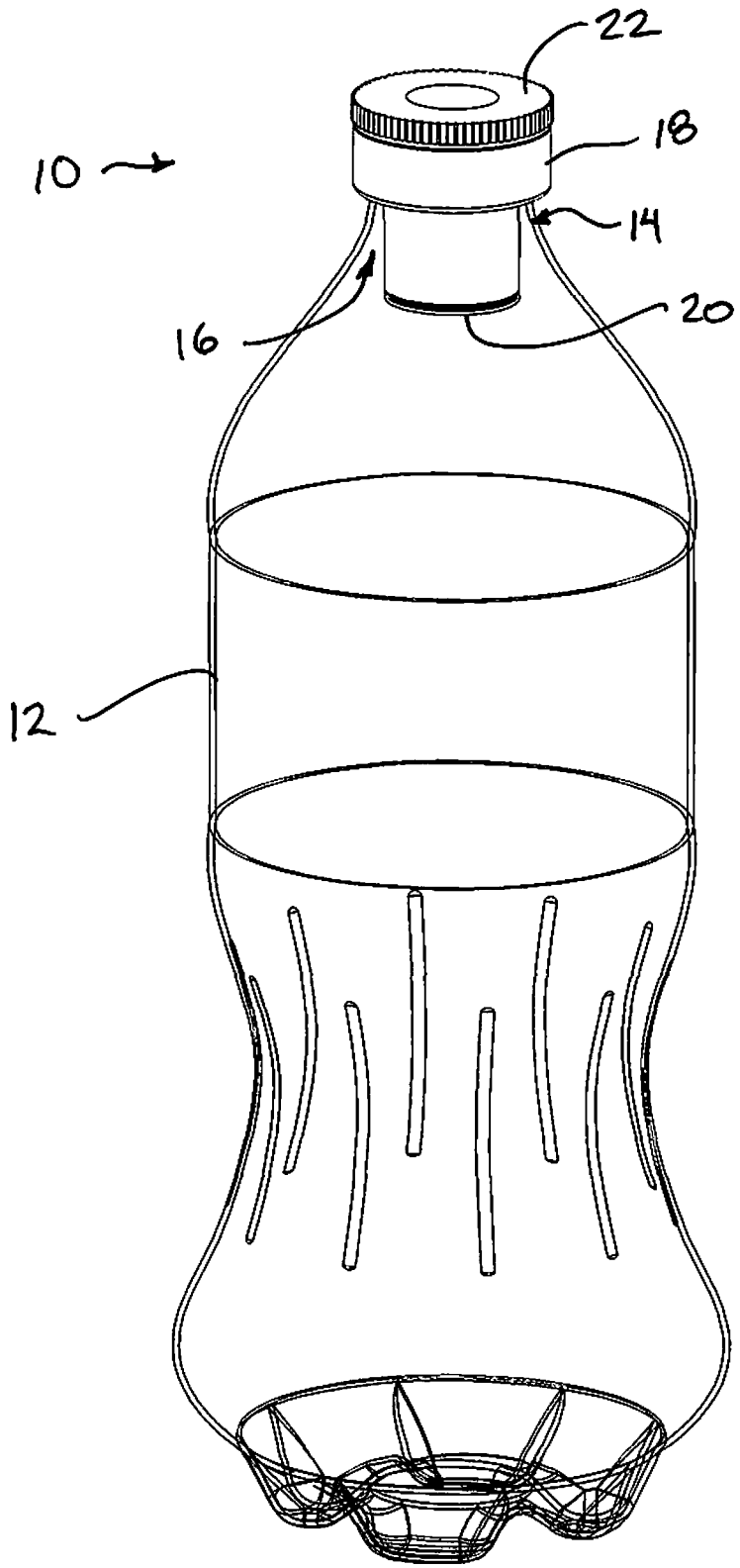
FIG. 1 is a perspective view of the closure device supported on a carbonated beverage bottle in which the device is shown in a closed position.

Referring to the accompanying figures, there is illustrated a fluid dispensing closure device generally indicated by reference numeral 10. The device 10 is particularly suited for use with a fluid container, for example a beverage bottle 12 or other suitable liquid containing vessel including a neck 14 extending upwardly to a top opening 16 from which contents of the container can be dispensed. More particularly, the neck 14 includes a cylindrical upper portion which is externally threaded to receive a conventional closure device in the form of a bottle cap thereon.

The closure device 10 is particularly suited for closing the top opening 16 on the neck of a bottle 12 containing a pressurized liquid beverage therein. The closure device 10 is operable between an open position for dispensing the liquid therethrough and a closed position for containing pressure within the bottle 12. When the bottle is inverted prior to opening of the closure device 10, any gas pressure within the bottle can be maintained at the top end of the inverted bottle while the liquid beverage is dispensed through the opened closure device at the bottom end of the inverted bottle.

The closure device 10 is also well-suited for use with a variety of other liquid container for example plastic, metal, or glass jugs or bottles capable of containing various liquids therein including household products, automotive fluids and the like. In each instance, when the container is provided with a neck which is threaded, the closure device 10 can be sized for threading onto the neck while being similarly operable between closed and open positions for selectively dispensing the liquid from the container.

In the preferred embodiments, the closure device 10 generally includes (i) an outer member 18 arranged to be threaded onto the neck of the bottle and defining a fluid passage through which the contents of the bottle can be dispensed, (ii) a valve member 20 which is operable relative to the fluid passage defined in the outer member 18 between opened and closed positions, and (iii) an actuator member 22 which is supported to be externally accessible on the outer member 18 while being operatively connected to the valve member 20 for opening and closing the valve member relative to the fluid passage. Each of the outer member 18, the valve member 20, and the actuator member 22 may be formed as a single unitary piece of material, or may be formed as an assembly of two or more pieces joined together to collectively define the overall function of the member as described herein.

Figure 2:
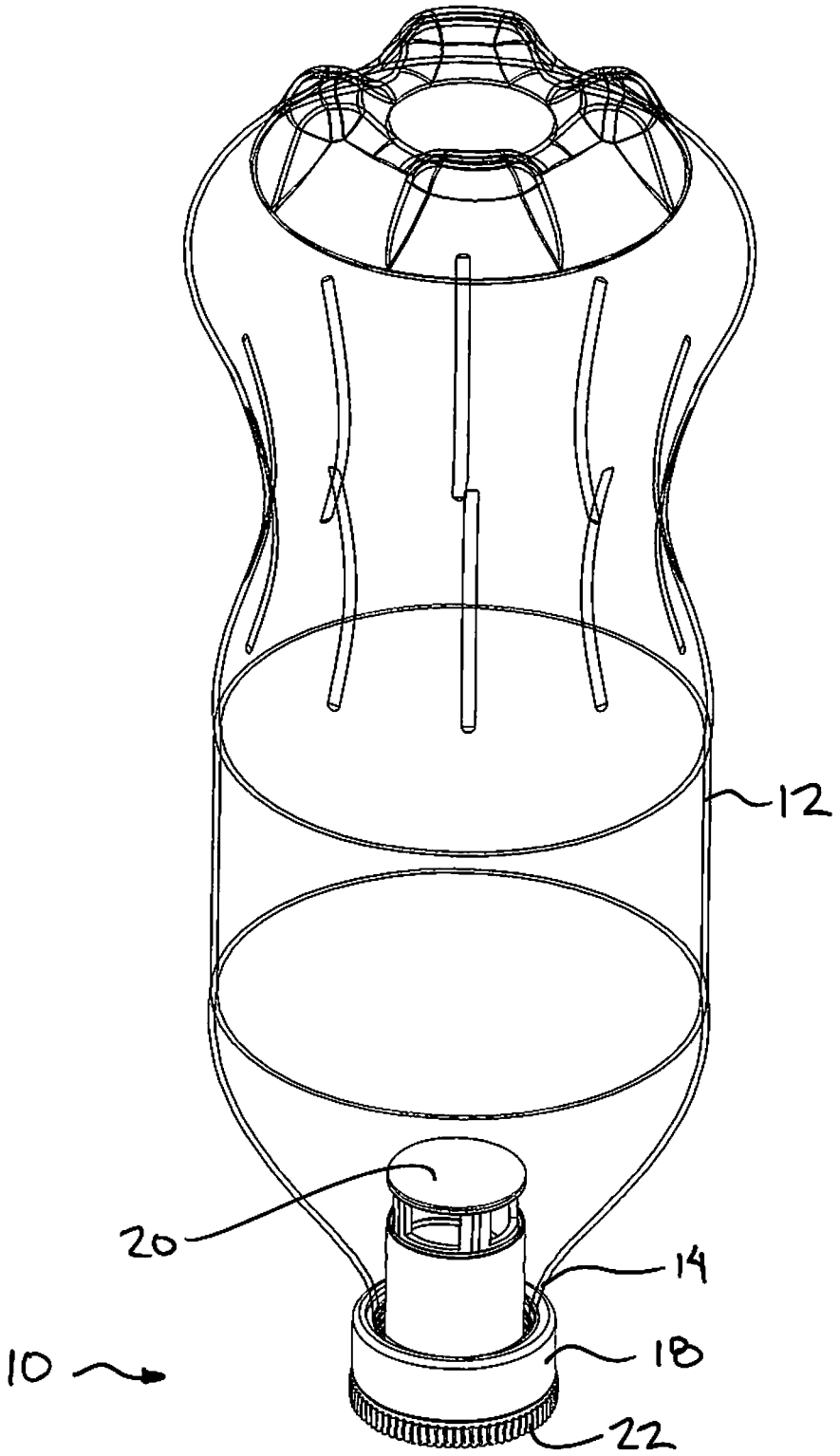
FIG. 2 is a perspective view of the closure device supported on the bottle in an inverted orientation for dispensing in which the device is shown in an open position.
Figure 3:
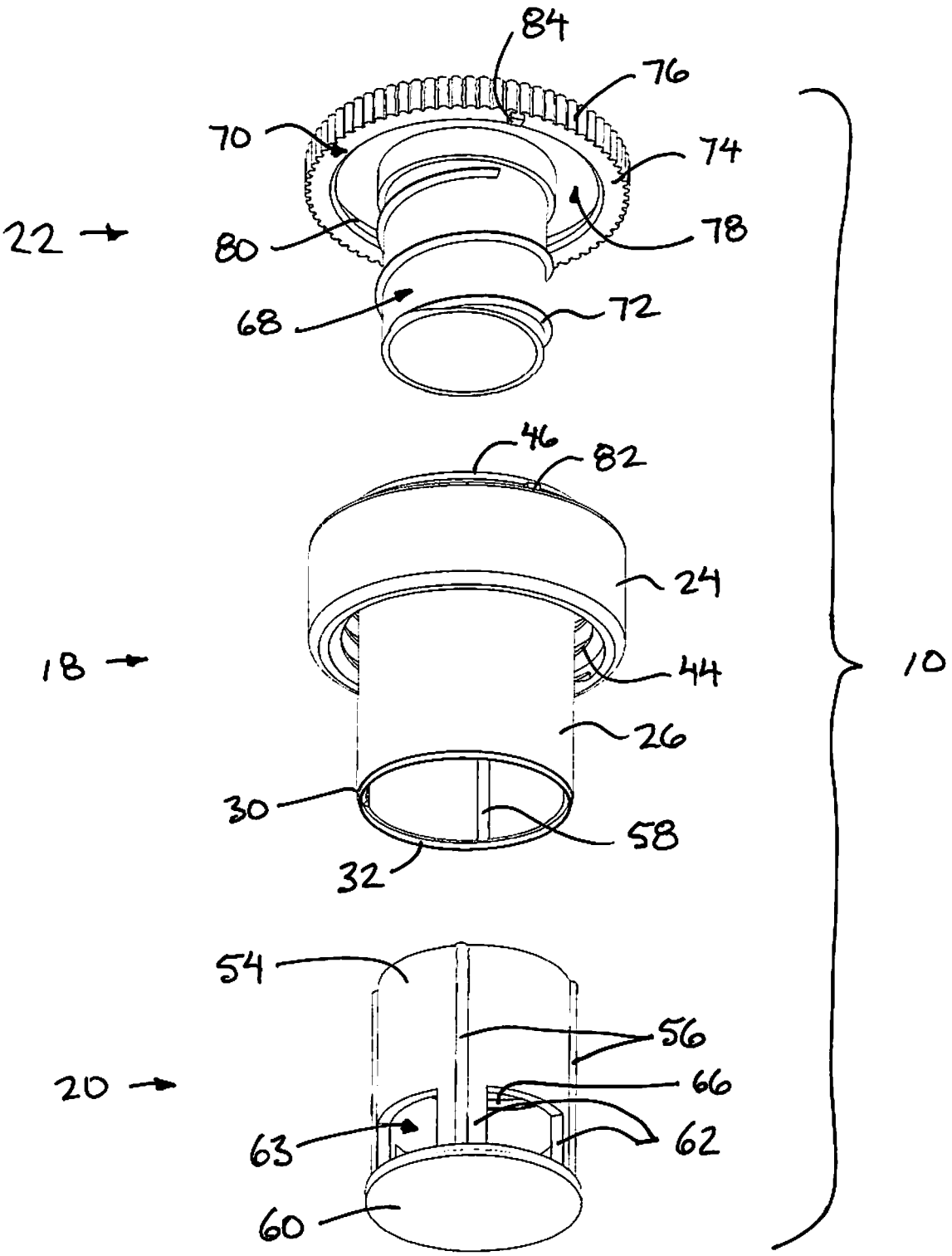
FIG. 3 is an exploded perspective view of the closure device viewed from below.
Figure 4:
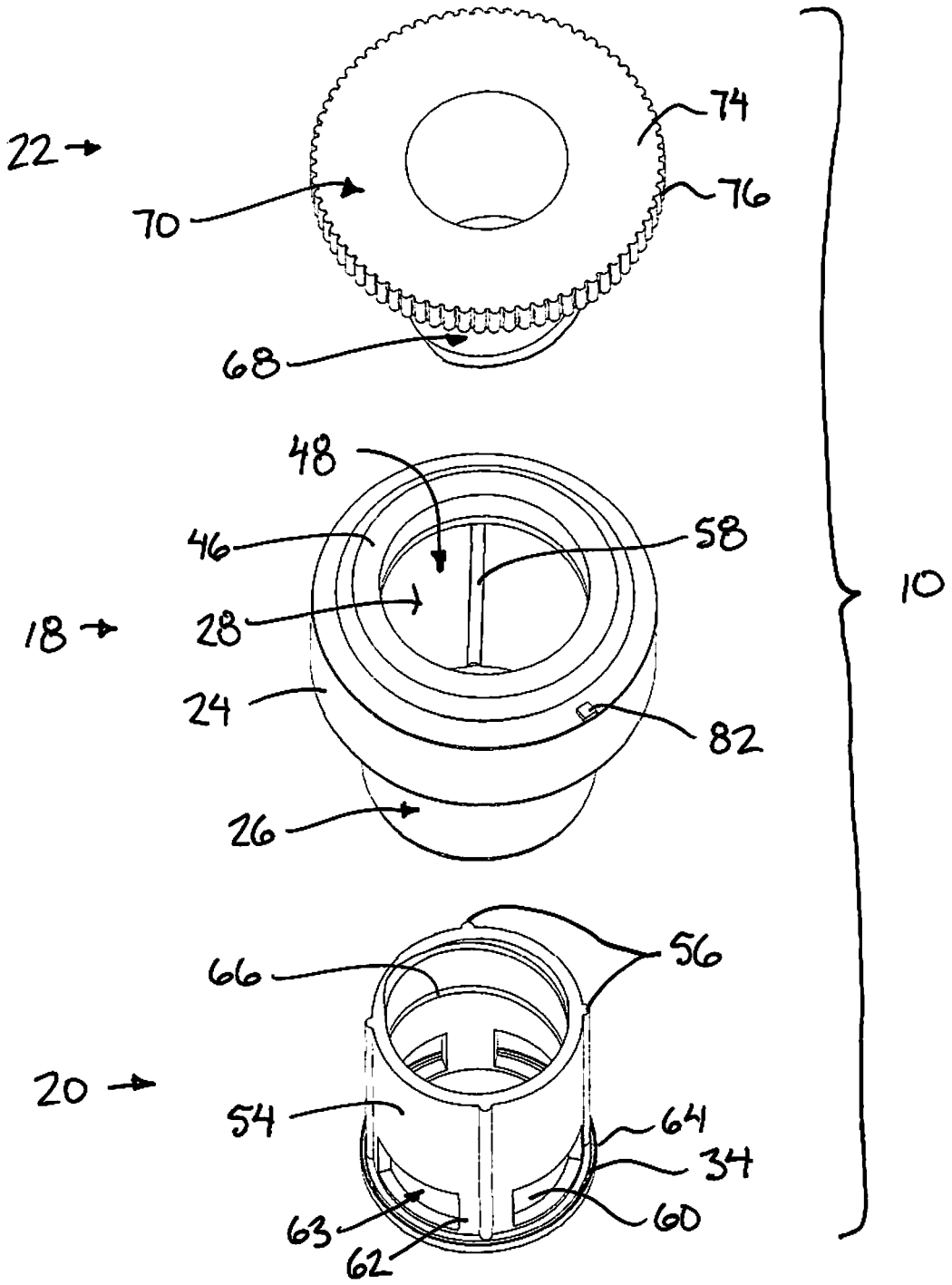
FIG. 4 is another exploded perspective view of the closure device viewed from above.
Figure 5:
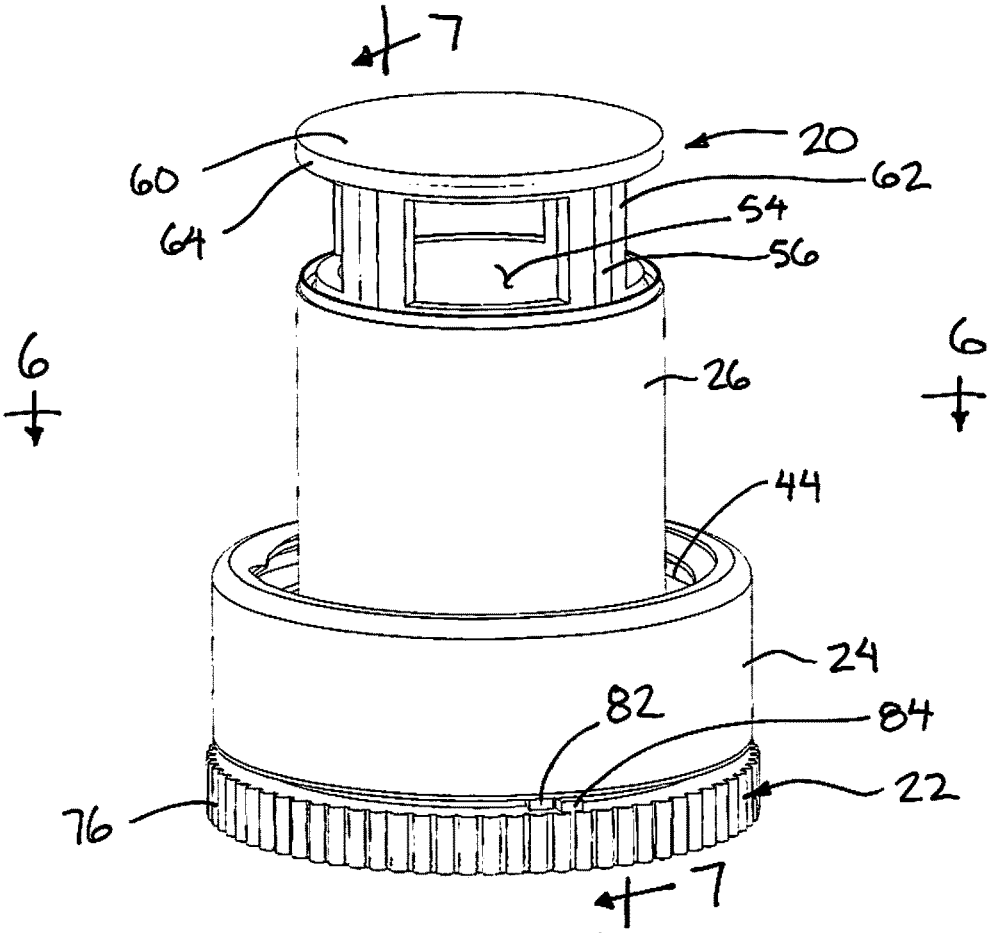
FIG. 5 is a perspective view of the closure device separated from the bottle, in an inverted orientation with the valve member in an open position.
Figure 6:
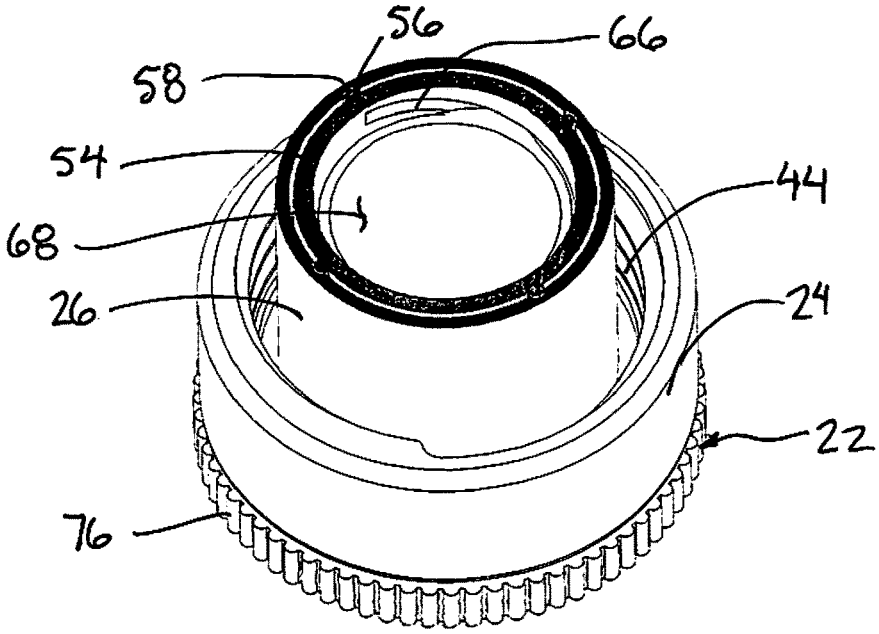
FIG. 6 is a partly sectional view of the closure device along the line 6-6 in FIG. 5.
Figure 7:
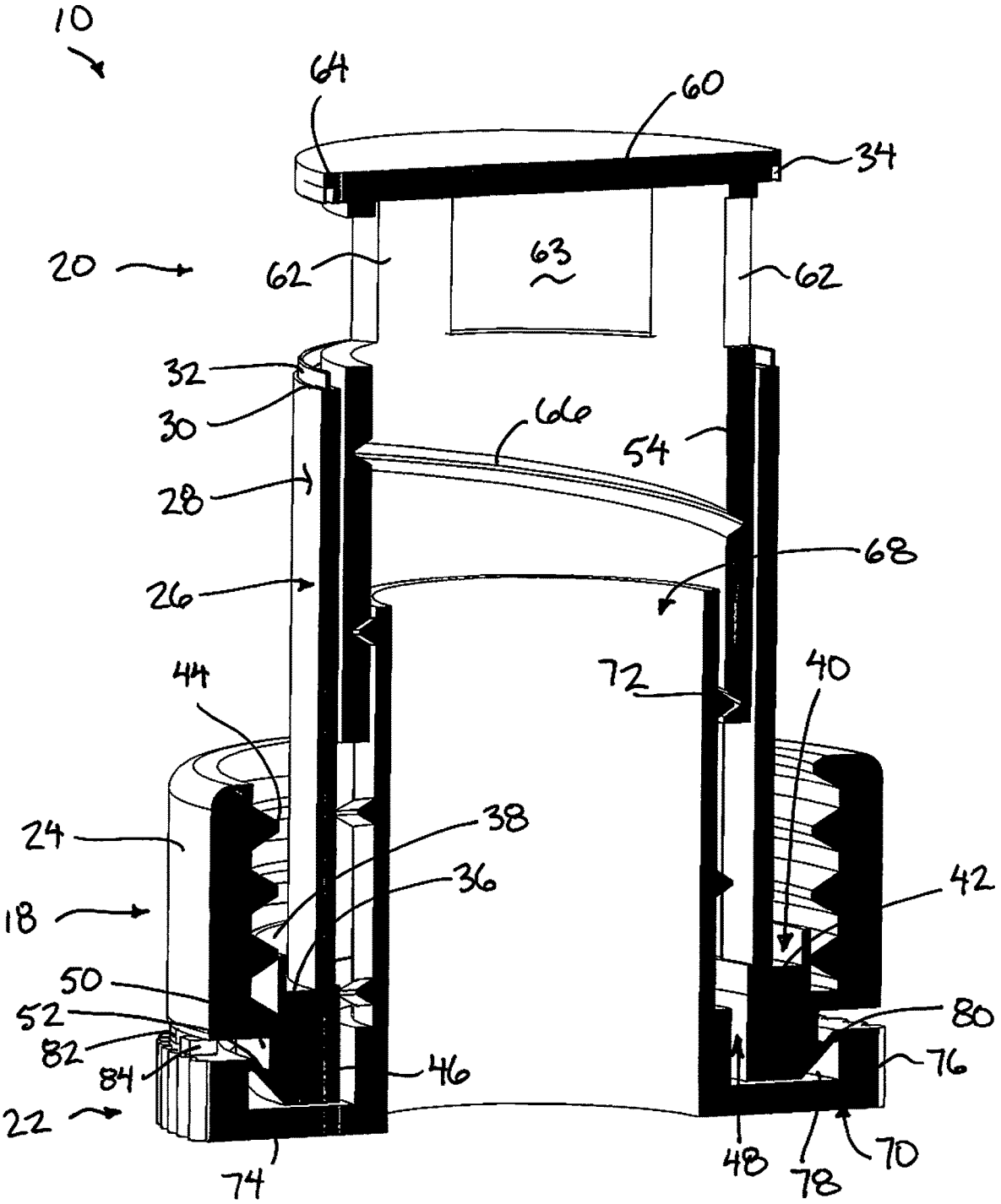
FIG. 7 is a sectional view of the closure device generally along the line 7-7 in FIG. 5.
Figure 8:
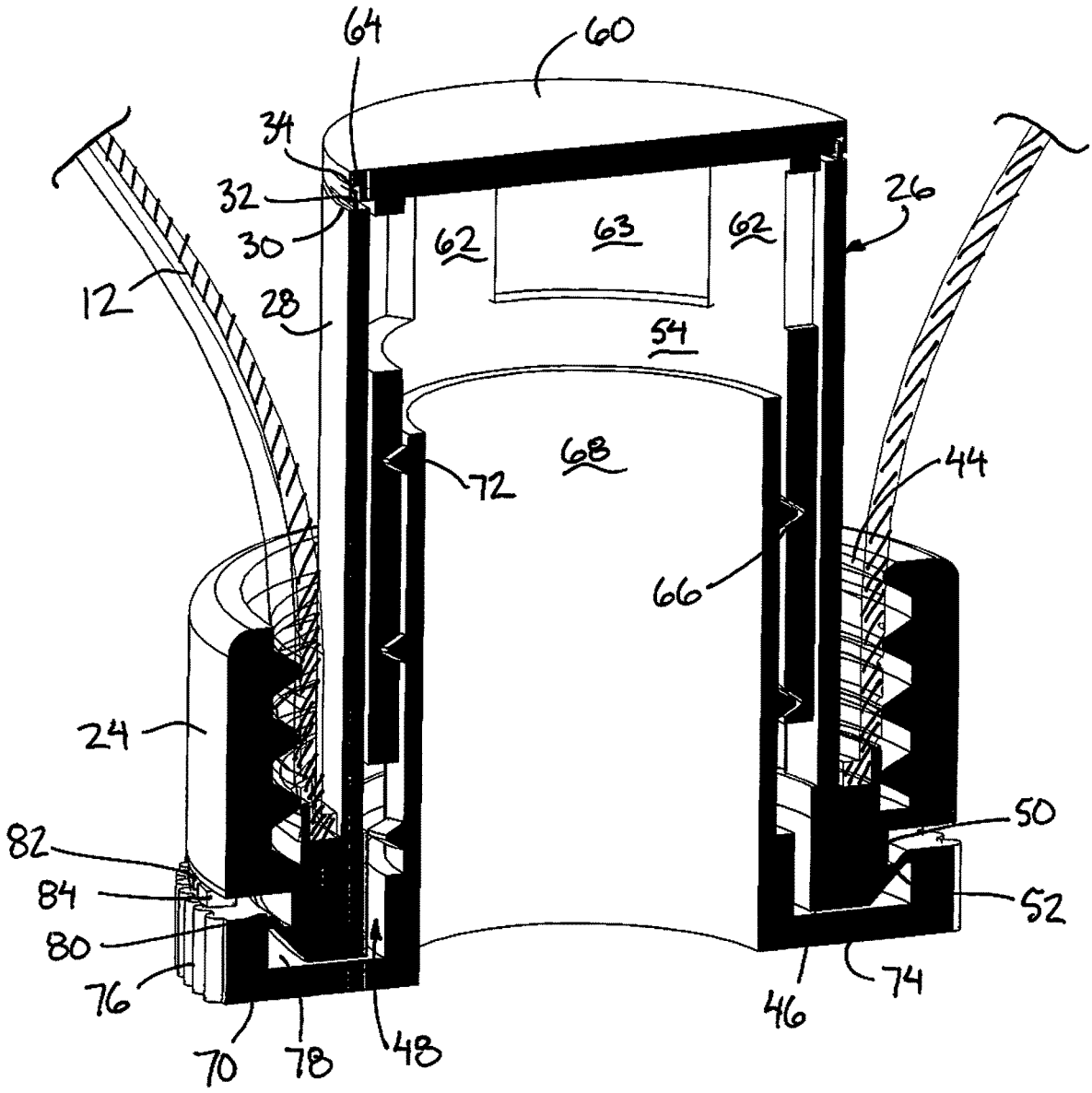
FIG. 8 is a sectional view of the closure device similar to FIG. 7, but with the closure device shown in a closed position supported on the bottle.

Throughout the following description, the top end of the closure device 10 is generally understood to refer to the uppermost portion of the closure device when supported at the top end of a bottle in a normal orientation is illustrated in FIG. 1 or the lowermost portion of the closure device when supported on the neck of a bottle in an inverted orientation according to FIG. 2. In use, the closure device is typically only opened once the bottle has been displaced into the inverted position of FIG. 2 so that any gas contained under pressure within the bottle remains contained at the uppermost portion of the bottle while the liquid contents of the bottle can be dispensed through the closure device 10 at the lowermost portion of the inverted bottle.

The outer member 18 is generally comprised of two separate components including a collar portion 24 arranged for threading onto the neck of the bottle and an inner sleeve 26 that extends into the bottle to define the fluid passage of the closure device through which the liquid contents of the bottle are dispensed. These two components may be formed separately according to the illustrated embodiment or as a single unitary body according to further embodiments.

The inner sleeve 26 generally includes a tubular main body 28 having an outer diameter which closely fits within the inner diameter of the opening in the neck of the bottle.

The fluid passage is partly defined by the interior surface of the tubular main body extending in an axial direction through the outer member from the bottom end to the top end of the device. A valve seat 30 is defined at the bottom end of the tubular main body 28 as an annular in the face oriented perpendicularly to the axial direction of the sleeve. The valve seat 30 further includes an annular sealing flange 32 supported on the end face at the bottom of the tubular main body. The annular sealing flange is generally cylindrical in shape so as to project axially outward from the bottom end face of the main body for cooperation with an annular groove 34 of the valve member 20 as described in further detail below.

The inner sleeve further includes a radial flange 36 mounted on the top end thereof to extend radially outward from the tubular main body about the full circumference thereof. The radial flange 36 further supports a depending flange 38 which is cylindrical in shape and which extends downward from the outer perimeter edge of the radial flange at a location spaced radially outward from the cylindrical outer surface of the tubular main body 28. The radial flange 36 and the depending flange 38, together with an upper end of the tubular main body 28 collectively define a U-shaped channel 40 beneath the radial flange 36 at the top end of the inner sleeve which snugly receives the top end portion of the neck of the bottle inserted therein when the closure device is mounted onto the neck of the bottle. More particularly, the inner surface of the channel 40 below the radial flange 36 defines an annular surface 42 which is perpendicular to the axial direction of the sleeve for abutment against the annular end face of the neck of the bottle about the top opening of the bottle.

An optional gasket may be received within the channel 40 to enhance the sealing interface between the annular surface 42 of the inner sleeve 26 and the open top end of the bottle upon which the closure device is mounted.

The collar portion 24 of the outer member 18 comprises a collar having an interior diameter which fits around the outer diameter of the neck of the bottle and which includes internal threads 44 formed thereon for mating with the corresponding external threads about the neck of the bottle. The collar portion 24 receives the tubular main body 28 of the inner sleeve concentrically therein such that there is a resulting radial gap between the inner surface of the collar portion 24 and the outer surface of the tubular main body 28 of the inner sleeve 26 of suitable size to receive the wall thickness of the neck of the bottle therein in a mounted position of the closure device on the bottle.

An upper portion 46 is provided above the main body of the collar portion 24 to extend radially inward from the top end of the collar portion directly above the radial flange 36 of the inner sleeve. In this manner, tightening the threads of the collar portion onto the neck of the bottle causes the upper portion 46 of the outer member to be engaged upon the radial flange 36 of the inner sleeve 26 in a manner that tightly engages the annular surface 42 in sealing engagement against the top end of the bottle. The upper portion 46 extends inward from the top end of the collar portion above the radial flange 36 of the inner sleeve to a central opening 48 having a cylindrical inner surface with an interior diameter which is approximately equal to the inner diameter of the fluid passage extending through the tubular main body 28 of the inner sleeve directly therebelow.

The outer diameter of the upper portion 46 is reduced relative to the main body of the collar portion 24 below to provide a recessed area that receives part of the actuator member 22 therein as described in further detail below. The exterior surface of the upper portion 46 which is stepped radially inward relative to the collar portion 24 below further locates an annular groove 50 therein such that an upper boundary of the annular groove defines a shoulder surface 52 which is perpendicular to the axial direction and which faces downwardly towards the bottom of the bottle so as to be suitable for retaining a portion of the actuator member thereon to prevent axial displacement of the actuator member 22 relative to the outer member 18 while permitting relative rotation therebetween as further described below.

The valve member 20 includes a tubular body portion 54 which is received inside the inner sleeve 26 of the outer member within the neck of the bottle. The outer diameter of the tubular body portion 54 is approximately the same as the inner diameter of the inner sleeve so as to allow some relative movement between the valve member and the inner sleeve of the outer member. A set of four keys 56 are provided externally on the tubular body portion 54 to be received within a corresponding set of four keyways 58 recessed into the inner surface of the inner sleeve 26 of the outer member.

More particularly, each of the keys 56 is a radially protruding rib which extends in the axial direction of the sleeve at evenly spaced apart positions in the circumferential direction relative to the other keys 56. Likewise, each of the four keyways 58 is a groove which extends in the axial direction of the sleeve at evenly spaced apart positions in the circumferential direction relative to the other keyways 58. The profile of each keyway is substantially identical to the profile of the corresponding key 56 received therein. The interaction between the keys 56 and the keyways 58 allow longitudinal sliding movement in the axial direction of the sleeve between the valve member 20 and the inner sleeve 26 of the outer member 18 while coupling the valve member and the outer member non-rotatably relative to one another.

The valve member 20 further includes a valve body 60 supported at the bottom end of the tubular body portion 54 at a location spaced below the bottom end of the tubular body portion by a set of four axially extending legs 62 connected between the bottom end of the tubular body portion and the valve body 60 at evenly spaced apart positions in the circumferential direction. In this manner an annular discharge area is formed between the valve body 60 below and the tubular body portion 54 above, in which the annular discharge area is collectively defined by a plurality of circumferentially spaced apart discharge openings 63 between respective pairs of the legs 62. In the open position, the bottom end of the tubular body portion 54 the valve member is located approximately adjacent to the bottom end of the inner sleeve 26 such that the annular discharge area formed by the plurality of discharge openings 63 is located fully below and unobstructed by the tubular body portion. To close the valve member, the valve member is displaced in the axial direction for translating movement relative to the inner sleeve 26 of the outer member, upwardly until the valve body 60 is abutted against the valve seat 30 at the bottom end of the inner sleeve corresponding to the fully closed position.

The valve body 60 generally comprises a circular plate having a diameter which is slightly greater than the diameter of the tubular body portion and which is substantially identical to the outer diameter of the inner sleeve 26 of the outer member. In this manner, a peripheral edge portion of the valve body 60 defines a flange 64 protruding radially outward from the tubular body portion 54 at the bottom end thereof about the full circumference of the valve member. The protruding flange portion 64 of the valve body locates the annular groove 34 at the top side of the flange facing the bottom end of the inner sleeve where the annular sealing flange 32 is located. Accordingly, when the valve member is displaced into the closed position, the annular sealing flange 62 on the valve seat is snugly received into the annular groove 34 about the periphery of the valve body to ensure a sealing interface which is sealed against the pressurized fluid in the bottle in the closed position.

An optional gasket may be incorporated into the annular groove 34 to improve the pressurized seal between the valve body and the bottom end of the inner sleeve.

The tubular body portion 54 of the valve member further includes a helical groove 66 formed in the cylindrical inner surface of the tubular body portion. The helical groove 66 defines internal threads on the valve member for cooperation with the actuator member 22 as described in further detail below.

The actuator member 22 is rotatably supported relative to the collar portion 24 and inner sleeve 26 of the outer member 18. The actuator member includes an internal portion 68 extending downwardly into the fluid passage of the closure device to be operatively connected to the valve member and an external portion 70 supported externally on the top end of the collar portion 24 of the outer member 18 so as to be externally accessible by an operator for operating the valve member between the open and closed positions thereof.

The internal portion 68 of the actuator member comprises a tubular body having an outer diameter which is approximately the same as the inner diameter of the tubular body portion 54 of the valve member within which it is received. An external thread 72 is formed on the exterior surface of the tubular body of the internal portion in the form of a protruding rib extending helically about the tubular body to form a mating connection with the corresponding helical groove 66 in the inner surface of the tubular body portion 54 of the valve member. Due to the threaded connection formed between the actuator member and the valve member, rotating the actuator member while the actuator member remains fixed in place in the axial direction relative to the valve seat on the inner sleeve of the outer member, causes the valve member to be displaced in the axial direction between the open and closed positions thereof depending upon the direction of rotation of the actuator member.

The external portion 70 of the actuator member comprises an annular flange 74 extending radially outward from the top end of the tubular body of the internal portion 68 to an outer perimeter edge 76 of the external portion 70. The outer diameter at the perimeter edge 76 is approximately equal to or slightly greater than the outer diameter of the collar portion 64 of the outer member below. The perimeter edge 76 is knurled to provide a gripping texture for ease of driving rotational movement of the actuator member relative to the outer member 18 in operation.

An undercut area 78 is formed under the annular flange 74 which receives the upper portion 46 of the outer member 18 therein in a mounted position of the actuator member on the outer member 18. A retainer flange 80 extends radially inward from the outer boundary of the undercut area 78 to define a catch surface thereon which is perpendicular to the axial direction and which faces upwardly to be suitable for being retained against the shoulder surface 52 on the upper portion 46 of the outer member 18. The vertical dimension between the catch surface on the retainer flange 80 and the uppermost boundary of the undercut area 78 is approximately equal to the vertical distance between the top end of the upper portion 46 and the shoulder surface 52 of the outer member so that the actuator member is restricted in both directions in the axial direction relative to the outer member while the actuator member remains rotatable about the longitudinal axis of the closure device relative to the outer member. A bottom face of the retainer flange 80 is sloped upwardly and inwardly towards the inner edge of the retainer flange, while the corresponding surface of the upper portion 46 immediately above the shoulder surface 52 is similarly sloped so that the actuator member can be assembled onto the outer member by pressing the external portion 70 of the actuator member downwardly over top of the upper portion 46 of the outer member 18. The sloped surfaces guide the catch surface on the actuator member outwardly by resilient deformation past the outer boundary of the shoulder surface 52 such that upon the catch surface being located below the shoulder surface, the catch surface returns into an interfering relationship with the shoulder member to be retained upon the shoulder member in a snap fit arrangement.

A small gap is provided in the axial direction between the bottom of the annular flange 74 of the actuator member and the top of the collar portion 24 of the outer member below. A first stop 82 is mounted to protrude axially upward from the top of the collar portion 24 within the gap while a second stop 84 is mounted on the bottom of the retainer flange 80 to extend downwardly toward the collar portion also within the gap. The pitch of the threaded connection between the actuator member and the valve member is arranged such that a single near complete rotation of the actuator member causes the valve member to be fully displaced in the axial direction from the closed position to the open position, and a near complete rotation in the opposing direction returns the valve member from the open position to the closed position. The first stop 82 is abutted against a first side of the second stop 84 to prevent further rotation in one direction beyond the open position. Likewise, the first stop 82 is abutted against an opposing second side of the second stop 84 to prevent further rotation in the opposing direction beyond the closed position to prevent damage to the threaded connection by over rotation.

The design of the closure device described above further enables the entirety of the outer member, the valve member, and the actuator member to be formed of polyethylene terephthalate (PET) material. This enables the closure device and commonly available PET bottles (upon which the closure device is typically mounted) to be recycled in a common recycling stream, facilitating recycling in a cost effectively manner and reducing environmental levies where applicable.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A fluid dispensing closure device for a fluid container including a neck defining an opening at a top of the neck and external threads on the neck, the device comprising:

an outer member including (i) a collar portion having an inner diameter sized to receive the neck of the fluid container therein and defining internal threads thereon so as to be arranged to be threaded onto the external threads on the neck of the fluid container, (ii) an inner sleeve disposed within the collar portion and having an outer diameter sized to be received within the opening in the neck of the fluid container, the inner sleeve defining a fluid passage through the outer member in an axial direction of the inner sleeve, and (iii) an annular surface extending radially between a top end of the inner sleeve and the collar portion so as to be arranged to form a seal against the top of the neck of the fluid container about the opening of the fluid container;

a valve member supported on the inner sleeve so as to be movable relative to the inner sleeve in the axial direction of the inner sleeve between a closed position in which a valve body portion of the valve member is seated on a valve seat on the inner sleeve to block fluid flow through the fluid passage of the inner sleeve and an open position in which the valve body portion of the valve member is displaced in the axial direction from the valve seat to allow fluid flow through the fluid passage; and an actuator member rotatably supported on the outer member and including (i) an external portion that is externally accessible on the collar portion of the outer member and (ii) an internal portion in operative connection with the valve member such that rotation of the actuator member drives axial displacement of the valve member between the open position and the closed position thereof;

wherein the actuator member is operatively connected to the valve member by a threaded connection.

2. The device according to claim 1 wherein the actuator member is restricted from moving in the axial direction as the valve member is displaced between the open position and the closed position.

3. The device according to claim 1 wherein the inner sleeve of the outer member mates non-rotatably with one of the valve member and the actuator member such that relative movement between the outer member and said one of the valve member and the actuator member is restricted to translating movement in the axial direction.

4. The device according to claim 3 wherein the valve member mates non-rotatably with the outer member such that the valve member is restricted to translation movement relative to the outer member between the open and closed positions of the valve member.

5. The device according to claim 1 wherein the valve seat is an annular surface at a bottom end of the inner sleeve of the outer member and the valve body portion of the valve member spans across the bottom end of the inner sleeve in the closed position, a first one of the valve seat and the valve body portion supporting an annular flange projecting therefrom in the axial direction and a second one of the valve seat and the valve body portion having an annular groove formed thereon, the annular flange being received within the annular groove in the closed position of the valve member.

6. The device according to claim 1 wherein the valve member includes a tubular body portion received within the inner sleeve of the outer member, the tubular body portion having an outer diameter which is similar to an inner diameter of the inner sleeve.

7. The device according to claim 1 further comprising a sealing interface between the actuator member and the outer member which maintains a pressurized seal between the actuator member and the outer member as the valve member is displaced between the open and closed positions.

8. The device according to claim 1 wherein the internal portion of the actuator member comprises a tubular body received within the fluid passage of the outer member and wherein the external portion of the actuator member comprises an annular flange extending across a top end of the collar portion of the outer member.

9. The device according to claim 8 wherein the annular flange terminates at an outer perimeter edge having an outer diameter which is approximately equal to an outer diameter of the collar portion of the outer member.

10. The device according to claim 8 wherein the annular flange terminates at an outer perimeter edge, the outer perimeter edge being knurled.

11. The device according to claim 1 wherein the outer member consists of polyethylene terephthalate material.

12. The device according to claim 1 wherein the outer member, the valve member, and the actuator member each consist of polyethylene terephthalate material.

13. A fluid dispensing closure device for a fluid container including a neck defining an opening at a top of the neck and external threads on the neck, the device comprising:

an outer member including (i) a collar portion having an inner diameter sized to receive the neck of the fluid container therein and defining internal threads thereon so as to be arranged to be threaded onto the external threads on the neck of the fluid container, (ii) an inner sleeve disposed within the collar portion and having an outer diameter sized to be received within the opening in the neck of the fluid container, the inner sleeve defining a fluid passage through the outer member in an axial direction of the inner sleeve, and (iii) an annular surface extending radially between a top end of the inner sleeve and the collar portion so as to be arranged to form a seal against the top of the neck of the fluid container about the opening of the fluid container;

a valve member supported on the inner sleeve so as to be movable relative to the inner sleeve in the axial direction of the inner sleeve between a closed position in which a valve body portion of the valve member is seated on a valve seat on the inner sleeve to block fluid flow through the fluid passage of the inner sleeve and an open position in which the valve body portion of the valve member is displaced in the axial direction from the valve seat to allow fluid flow through the fluid passage; and an actuator member rotatably supported on the outer member and including (i) an external portion that is externally accessible on the collar portion of the outer member and (ii) an internal portion in operative connection with the valve member such that rotation of the actuator member drives axial displacement of the valve member between the open position and the closed position thereof;

wherein the valve member includes a tubular body portion received within the inner sleeve of the outer member in which the tubular body portion has an outer diameter which is similar to an inner diameter of the inner sleeve; and wherein the internal portion of the actuator member comprises a tubular body received within the tubular body portion of the valve member, the internal portion of the outer member having an outer diameter which is similar to an inner diameter of the tubular body portion of the valve member.

14. A fluid dispensing closure device for a fluid container including a neck defining an opening at a top of the neck and external threads on the neck, the device comprising:

an outer member including (i) a collar portion having an inner diameter sized to receive the neck of the fluid container therein and defining internal threads thereon so as to be arranged to be threaded onto the external threads on the neck of the fluid container, (ii) an inner sleeve disposed within the collar portion and having an outer diameter sized to be received within the opening in the neck of the fluid container, the inner sleeve defining a fluid passage through the outer member in an axial direction of the inner sleeve, and (iii) an annular surface extending radially between a top end of the inner sleeve and the collar portion so as to be arranged to form a seal against the top of the neck of the fluid container about the opening of the fluid container;

a valve member supported on the inner sleeve so as to be movable relative to the inner sleeve in the axial direction of the inner sleeve between a closed position in which a valve body portion of the valve member is seated on a valve seat on the inner sleeve to block fluid flow through the fluid passage of the inner sleeve and an open position in which the valve body portion of the valve member is displaced in the axial direction from the valve seat to allow fluid flow through the fluid passage; and an actuator member rotatably supported on the outer member and including (i) an external portion that is externally accessible on the collar portion of the outer member and (ii) an internal portion in operative connection with the valve member such that rotation of the actuator member drives axial displacement of the valve member between the open position and the closed position thereof;

wherein the collar portion of the outer member includes an annular groove defining a downwardly facing, annular shoulder surface on the collar portion that is perpendicular to the axial direction and wherein the external portion of the actuator member includes an undercut area locating a catch therein that engages the shoulder surface on the collar portion that prevents the actuator member from being displaced in the axial direction relative to the outer member.

* * * * *